United States Patent [19]

Strampach et al.

[11] Patent Number: 4,652,390

[45] **Date of Patent: * Mar. 24, 1987**

[54] OXIDATION RESISTANT TISSUE FOR DRY LAUNDRY ACTIVES AND BLEACH COMPATIBLE PRODUCTS

[75] Inventors: Norman A. Strampach, Mason; Vincent L. Cerchio, Jr.; William W. Schmidt, both of Cincinnati, all of Ohio

[73] Assignee: The Procter & Gamble Company, Cincinnati, Ohio

[ * ] Notice: The portion of the term of this patent subsequent to Jan. 27, 2004 has been disclaimed.

[21] Appl. No.: 748,654

[22] Filed: Jun. 25, 1985

[51] Int. Cl.[4] ..... C11D 17/04

[52] U.S. Cl. ..... 252/92; 252/90; 252/92; 252/94; 252/95; 252/174

[58] Field of Search ..... 252/90, 91, 93, 94, 252/92, 174; 427/242; 15/104.93

[56] References Cited

U.S. PATENT DOCUMENTS

| | | | |
|---|---|---|---|
| 1,075,210 | 10/1913 | Heyl et al. | 206/0.5 |
| 3,215,654 | 11/1965 | Schmalz | 260/17.3 |
| 3,240,761 | 3/1966 | Keim et al. | 260/78 |
| 3,700,623 | 10/1972 | Keim | 260/80.3 R |
| 3,833,531 | 9/1974 | Keim | 260/29.6 CM |
| 3,949,014 | 4/1976 | Maki et al. | 260/836 |
| 4,093,605 | 6/1978 | Hoppe et al. | 260/78 SC |
| 4,348,293 | 9/1982 | Clarke et al. | 252/90 |
| 4,373,992 | 2/1983 | Bondoc | 162/145 |
| 4,515,703 | 5/1985 | Haq | 252/92 |
| 4,529,480 | 7/1985 | Trokhan | 162/109 |
| 4,555,354 | 11/1985 | Clarke et al. | 252/90 |
| 4,562,218 | 12/1985 | Fornadel et al. | 524/15 |

FOREIGN PATENT DOCUMENTS

| | | |
|---|---|---|
| 11500 | 5/1980 | European Pat. Off. . |
| 11502 | 5/1980 | European Pat. Off. . |
| 11501 | 5/1980 | European Pat. Off. . |
| 105722 | 7/1984 | European Pat. Off. . |

OTHER PUBLICATIONS

"Trademarks and Product Names Section", of U.S. EPA Toxic Substances Control Act, May 1979, pp. 1183–1184.

*Primary Examiner*—Paul Lieberman
*Assistant Examiner*—Hoa Van Le
*Attorney, Agent, or Firm*—Leonard Williamson; Ronald L. Hemingway; Richard C. Witte

[57] ABSTRACT

This invention relates to an improved, premeasured, through the wash, dry laundry active product comprised of an oxidation resistant tissue and dry laundry actives contained therein. The oxidation resistant (OR) tissue is particularly useful as a durable substrate and a convenient vehicle for delivering laundry additives to a wash liquor comprising bleach. The improved products of this invention are storage stable, deliver premeasured actives and survive the wash without tearing or shredding.

25 Claims, 5 Drawing Figures

OXIDATION RESISTANT TISSUE FOR DRY LAUNDRY ACTIVES AND BLEACH COMPATIBLE PRODUCTS

BACKGROUND OF THE INVENTION

Prior art laundry products comprising tissue substrates which are designed to go through the wash are storage and/or wash unstable when the laundry product or the wash liquor comprises a strong bleach composition. It was recently discovered that the prior art tissue substrates containing peroxyacid bleach compositions fall apart upon prolonged storage and/or are torn or shredded in the wash, particularly at higher temperature automatic washes.

The requisite oxidation resistant strength of the paper used in combination with peroxyacid bleach cannot be obtained through the use of various wet strength resins commonly used in papermaking. Examples of such additives include wet strength agents such as urea-formaldehyde resins, melamine formaldehyde resins, polyamide-epichlorohydrin resins and dialdehyde starches. Complete descriptions of commonly used wet strength agents can be found in TAPPI Monograph Series Number 29, *Strength Resin in Paper and Paper Board,* Technical Association of the Pump and Paper Industry (New York 1965). It should be noted that wet strength resins are generally chosen for the oxidation receptivity for repulping. This is contrary to the resins useful in the present invention.

The reaction products (resins) of epihalohydrin and polymers of diallylamine and salts thereof and their use in paper are disclosed in U.S. Pat. Nos. 3,700,623, G. I. Keim, issued Oct. 24, 1972, and 3,833,531, G. I. Keim, issued Sept. 3, 1974; however, these patents do not teach that their resins would provide oxidation resistance for a tissue particularly when used in combination with a peroxyacid bleach or other laundry bleaching products.

OBJECTS OF PRESENT INVENTION

An object of the present invention is to provide a through the wash laundry active oxidation resistant (OR) tissue which is bleach resistant and will not be easily torn or shredded in an automatic wash containing bleach. Another object of the present invention is to provide a storage stable dry, through the wash laundry bleach product comprising an OR tissue and a dry bleach active for use in an automatic washer. Other objects will become apparent in the light of this disclosure.

SUMMARY OF THE INVENTION

This invention relates to a through the wash laundry product comprising: an oxidation resistant (OR) tissue, and a dry laundry active contained by said tissue wherein said OR tissue is characterized by having an original wet cross-directional (CD) tensile strength of at least 78 grams per centimeter and an Oxidation Resistance Test wet tensile strength of at least 77% of said original tensile strength as defined herein.

DETAILED DESCRIPTION OF THE INVENTION

Figure 1:
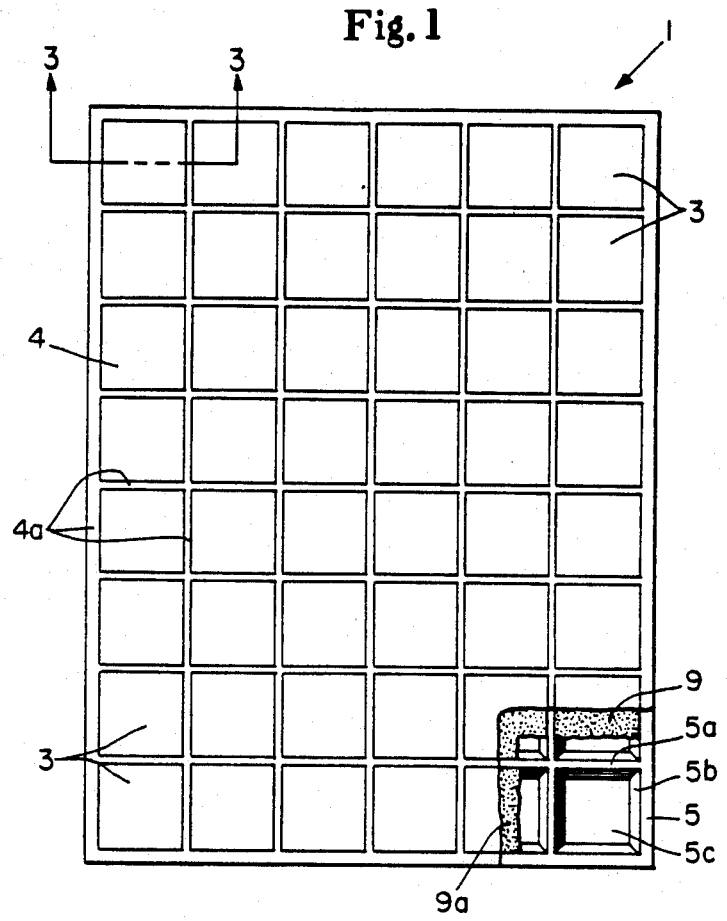
FIG. 1 is a top view of a preferred through the wash laundry product showing the tops of a multiplicity of nonconnecting cells (3) containing powdered laundry bleach and other actives, also shown are cups in the cells in a cutaway section.

The "through the wash" laundry active product of this invention is characterized as an OR tissue comprising an oxidation resistant resin and a dry laundry active for use in a bleach containing wash. The laundry active can be a dry bleach contained in an OR tissue laminate or a bleach composition impregnated in the OR tissue or coated on the OR tissue. The active can also be a softener, detergent powder, etc., contained by the OR tissue. The through the wash laundry product can survive a wash which contains bleach and surfactant at a level of from 5 to 440 ppm available oxygen at a pH of at least 8 (preferably at least 9) and a surfactant present at a level of about 150 ppm to about 2000 ppm. For peroxyacid bleaches the available oxygen range for a typical wash solution is generally 5 to 100 ppm because of their strength.

THE OR TISSUE PAPER

The terms "paper" and "tissue" as used herein are synonymous, unless otherwise specified. The procedure for performing the "Oxidation Resistance Test" is disclosed below following Table 3.

The oxidation resistant (OR) tissue is made with an effective amount of an oxidation resistant (OR) resin and has an original wet CD tensile strength of at least 78 grams per centimeter and an OR test tensile (wet CD tensile) strength of 77% of the original wet tensile strength as defined herein. The OR tissue of this invention can contain from 0.01% to about 10% of an oxidation resistant resin. The tissue has an original CD tensile strength of at least about 200 grams/inch (78 grams per centimeter) and a preferred oxidation resistance test (ORT) tensile strength of at at least 80% of said original wet tensile strength and a more preferred original wet tensile strength is at least 100 g/cm. A paper tissue which can pass this test is deemed a suitable vehicle for containing or carrying laundry actives into a through the wash operation without being torn or rent asunder. The tissue which passes this test is, thus, rendered suitable for the packaging of dry bleach powders.

The preferred tissue basis weight is 20–28 lbs. per ream (32 to 46 g/m$^2$). The OR tissue preferably has a porosity of from about 80 to 180 cubic feet per minute per square foot (CFM/ft$^2$), and more preferably has a porosity of from 100 to 140 CFM/ft$^2$. A "ream" as used herein is 3,000 square feet (279 sq. meters). Also, the oxidation resistant (OR) tissue more preferably has a CD stretch of from about 9% to about 30% and a MD stretch of from about 45% to about 55% and has a basis weight of from 20 to 30 lbs. per ream and has a wet CD tensile strength of from about 200 to 800 grams per inch.

The MD tensile strength is generally greater than the CD tensile strength. The OR tissue preferably has a practical basis weight of from about 15 to 35 lbs per 3,000 sq. ft. (24–49 g/m$^2$) and more preferably has a basis weight of from about 20 to about 25 lbs. per 3,000 sq. ft. (32–41 g/m$^2$).

The OR tissue of this invention has a practical dry caliper of from about 10 to about 35 mils (0.25–0.89 mm), preferably a dry caliper of from about 20 to about 30 mils (0.51–0.76 mm). The tissue more preferably has air permeability of from about 100–150 CFM/ft$^2$. Dry caliper is obtained with a Model 549M motorized micrometer such as is available from Testing Machines, Inc. of Amityville, Long Island, N.Y. Product samples are subjected to a loading of 80 grams per square inch under a 2-inch diameter anvil. The micrometer is zeroed to assure that no foreign matter is present beneath the anvil prior to inserting the samples for measurement and calibrated to assure proper readings. Measurements are read directly from the dial on the micrometer and are expressed in mils.

It is desirable that the tissue exhibit an air permeability of from about 80 to about 180 CFM/ft$^2$ as measured according to ASTM Method D-737.

Tissues useful herein can be made from any convenient papermaking fiber. Preferred are softwood fibers liberated from the native wood by the common Kraft papermaking process. Fibers obtained from hardwoods and fibers obtained by the various mechanical and chemimechanical papermaking processes, as well as synthetic papermaking fibers, can also be used.

Dry strength additives, such as polysalt coacervates rendered water insoluble by the inclusion of ionization suppressors are also useful herein.

One specific tissue paper making process found particularly useful in the present invention is the tissue paper process described by Trokhan in U.S. Pat. No. 4,529,480, issued July 16, 1985, incorporated herein by reference.

A paper web, which is sometimes known to the trade as a tissue paper web, is characterized as having two distinct regions.

The first is a network region which is continuous, macroscopically monoplanar, and which forms a preselected pattern. It is called a "network region" because it comprises a system of lines of essentially uniform physical characteristics which intersect, interlace, and cross like the fabric of a net. It is described as "continuous" because the lines of the network region are essentially uninterrupted across the surface of the web. (Naturally, because of its very nature paper is never completely uniform, e.g., on a microscopic scale. The lines of essentially uniform characteristics are uniform in a practical sense and, likewise, uninterrupted in a practical sense.) The network region is described as "macroscopically monoplanar" because, when the web as a whole is placed in a planar configuration, the top surface (i.e., the surface lying on the same side of the paper web as the protrusions of the domes) of the network is essentially planar. The network region is described as forming a preselected pattern because the lines define (or outline) a specific shape (or shapes) in a repeating (as opposed to random) pattern.

The second region of the tissue paper web comprises a plurality of domes dispersed throughout the whole of the network region, each being encircled by portions of the network region. The shape of the domes (in the plane of the paper web) is defined by the network region. This second region of the paper web is denominated as a plurality of "domes" for convenience because each section appears to extend from (protrude from) the plane formed by network region when viewed by an imaginary observer examining the tissue paper web from the direction of a first surface of the web. When viewed by an imaginary observer examining the tissue paper web from the direction of the second surface of the web, the second region comprises arcuate shaped voids which appear to be cavities or dimples.

The density (weight per unit volume) of the network region is high relative to the density of the domes.

Those skilled in the art are familiar with the effect of creping on paper webs. In a simplistic view, creping provides the web with a plurality of microscopic or semi-microscopic corrugations which are formed as the web is foreshortened, the fiber-fiber bonds are broken, and the fibers are rearranged. In general, the microscopic or semi-microscopic corrugations extend transversely across the web. That is to say, the lines of microscopic corrugations are perpendicular to the direction in which the web is traveling at the time it is creped (i.e., perpendicular to the machine direction). They are also parallel to the line of the doctor blade which produces the creping. The crepe imparted to the web is more or less permanent so long as the web is not subjected to tensile forces which can normally remove crepe from a web. In general, creping provides the paper web with extensibility in the machine direction. Preferably, the tissue paper web used herein is creped.

The particularly preferred paper web described above can be made according to the process described in the hereinbefore incorporated U.S. Patent of Trokhan. That process is briefly described in the following paragraphs.

The first step in the process involves providing an aqueous dispersion of papermaking fibers and, optionally, papermaking chemicals. The fibers and chemicals mentioned herein can be used. Techniques well known to those skilled in the papermaking art can be used to prepare this dispersion which is sometimes known as a papermaking furnish.

The second step in the process is forming an embryonic web of papermaking fibers from the papermaking furnish on a first foraminous member. The fibers in the embryonic web have a relatively large quantity of water associated with them; consistencies in the range of from about 5% to about 25% are satisfactory. (Percent consistency is defined as 100 times the quotient obtained when the weight of dry fiber in the system under discussion is divided by the total weight of the system.) The embryonic web is generally too weak to be capable of existing without the support of an extraneous element such as the first foraminous member. The fibers within the embryonic web are held together by bonds weak enough to permit rearrangement of the fibers under the action of forces hereinafter described. Any of the numerous techniques well known to those skilled in the papermaking art can be used in the practice of this step. As a practical matter, continuous papermaking processes are preferred. Processes which lend themselves to the practice of this step are described in many references such as U.S. Pat. No. 3,301,746, Sanford and Sisson, issued Jan. 31, 1967, and U.S. Pat. No. 3,994,771, Morgan and Rich, issued Nov. 30, 1976, both incorporated hereto in by reference. The first foraminous member is a fourdrinier wire.

The third step is associating the embryonic web with a second foraminous member (a "deflection member") which is a continuous belt. The second foraminous member has one surface, the embryonic web-contacting surface, which comprises a macroscopically monoplanar network surface which is continuous and patterned and which defines within the second foraminous member a plurality of discrete, isolated, deflection conduits. The deflection conduits are continuous passages connecting the embryonic web-contacting surface with the opposite surface of the deflection member. The deflection member is constructed in such a manner that when water is caused to be removed from the embryonic web (as by the application of differential fluid pressure) in the direction of the foraminous member, the water can be discharged from the system without having to again contact the embryonic web in either the liquid or the vapor state. The network surface is essentially monoplanar and continuous so that the lines formed by the network surface form at least one essentially unbroken net-like pattern. The network surface defines within it the openings of the deflection conduits in the web-contacting surface of the deflection member.

Figure 5:
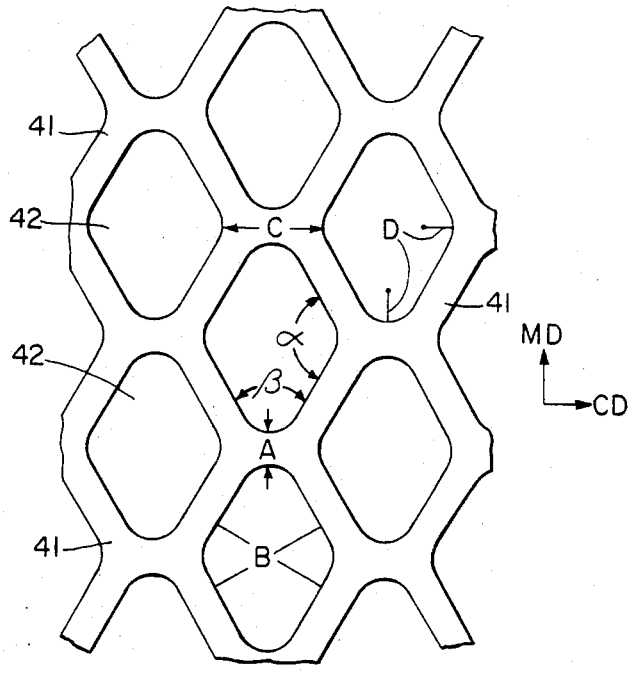
FIG. 5 is the pattern of a preferred papermaking belt.

The openings of the deflection conduits are in the form of rounded parallelograms distributed in a regularly repeating array as illustrated schematically in FIG. 5. Reference numeral 42 illustrates the openings of the deflection conduits while reference numeral 41 indicates the network surface. Angles alpha are about 120° and angles beta are about 60°. The dimensions of the rounded parallelograms and their orientations are: A is about 0.022 inch; B is about 0.086 inch; C is about 0.069 inch; and D is about 0.023 inch. (A=0.59 mm; B=2.18 mm; C=1.75 mm; D=0.59 mm). An inch is equal to 2.54 cm.

The fourth step is deflecting the papermaking fibers in the embryonic web into the deflection conduits and removing water from the embryonic web through the deflection conduits to form an intermediate web of papermaking fibers. The deflecting is done under such conditions that the deflection of the papermaking fibers is initiated no later than the time at which water removal through the conduits is initiated. Deflection of the fibers is introduced by the application of differential fluid pressure to the embryonic web by exposing the embryonic web to a vacuum in such a way that the vacuum is applied to the second surface of the deflection member and the web is exposed to the vacuum through the deflection conduits. Fibers in the embryonic web are deflected from the plane of the embryonic web into the deflection conduits without destroying the integrity of the web.

The fifth step is predrying the web with a flow-through dryer (hot air dryer) well known to those skilled in the art until the predried web has a consistency of about 75%.

The sixth step is impressing the network pattern of the surface of the deflection member into the predried web to form an imprinted web by pressing the predried web against the surface of a Yankee drum dryer with the deflection member. The surface speed of the Yankee dryer and the speed foraminous membrane is 0% to 20% less than the surface speed of the first foraminous membrane.

The seventh step is drying the imprinted web on the surface of the Yankee dryer (to which it has been adhered with polyvinyl alcohol) to a consistency of about 97%.

The eighth step is foreshortening the dried web by creping it from the surface of the Yankee dryer with a doctor blade.

The OR tissue used in the present invention must have certain wet tensile strength physical characteristics. The tissue preferably has multi-directional strength as well as multi-directional stretch (elongation potential) to allow the product of this invention to withstand the rigors of practical use. Specifically, the tissue can have a dry MD tensile strength of from about 1,200 to about 2,400 grams per inch, preferably at least about 1,400 grams per inch, with from about 30% to about 60% stretch, preferably at least about 45% as defined hereinbelow. It can have a dry CD tensile strength of from about 700 to about 1,500 grams per inch, preferably at least about 800 grams per inch, with from about 9 to about 30% CD stretch, preferably at least about 12%.

In papermaking, directions are normally stated relative to machine direction (MD) and cross-machine direction (CD). Machine direction refers to that direction which is parallel to the flow of the paper web through the papermaking machine. Measurements in the machine direction are made on the test specimen parallel to that direction. Cross-machine direction is perpendicular to a machine direction. Naturally, cross-machine direction measurements are made on the test secification in a direction at right angles to the machine direction.

The through the wash laundry product of this invention can comprise a dry bleach in combination with an oxidation resistant tissue for delivery of a predetermined amount of bleach to a wash. A preferred embodiment comprises the laminated laundry product shown in the drawings which comprises two plies of the oxidation resistant tissue with laundry actives contained inside patterned nonconnecting cells. The making of a two-ply laminate with stretch tissue is described in detail in commonly assigned U.S. patent application Ser. No. 675,804, Bedenk and Harden, filed Nov. 28, 1984, incorporated by reference in its entirety. The laminate is illustrated in the drawings.

FIG. 1 shows a top view of a laminated laundry product (1). The top ply tissue (4) covers the entire product (1) and also shows the multiplicity of cells (3) which are also shown in both FIGS. 1 and 3.

Figure 2:
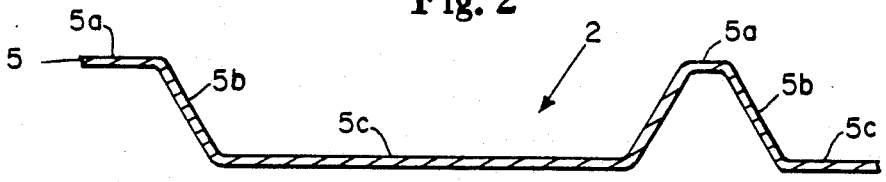
FIG. 2 shows a cross-sectional view of an embossed oxidation resistant tissue (5) showing nonconnecting cups (2).
Figure 3:
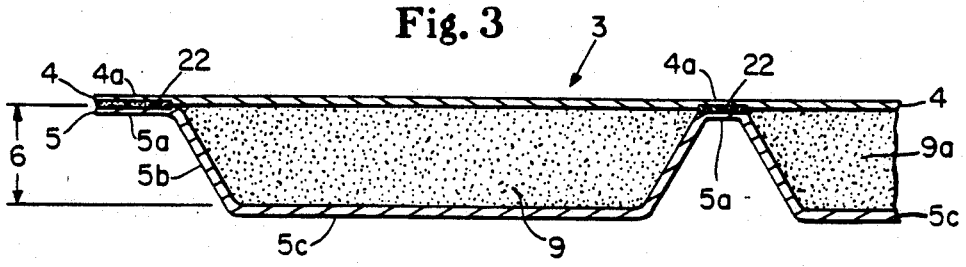
FIG. 3 is a cross-sectional view (3—3) of one of the laminated cells including deeply embossed oxidation resistant tissue (5) with nonconnecting cups (2) containing different powdered laundry actives (9 and 9*a*) and a top tissue (4).

FIG. 2 shows the embossed tissue (5) with rim (**5*a*), side (5*b*) and base (5*c*). FIG. 3 is a cross-sectional view along lines 3—3 of FIG. 1. The bottom tissue (5) is stretched at 5*b* about 15% to 100%, preferably 25% to 90%, to a depth (6) of about 2 to 8 mm, preferably 3 to 6 mm. The tissue (5) is embossed (stretched) to form a multiplicity of patterned cups (2) which have sides (5*b*) and a base (5*c*) of cells (3) and with the tops composed of a top tissue (4). The cells are pattern sealed with glue (22) at cups rims (5*a*) and top tissue (4*a***).

The laundry bleach and other actives (9 and **9*a*) are contained inside the sealed cells (3**). Thus, storage incompatible laundry actives are physically separated in the cells.

It is also understood that the top tissue can be a nonporous ply, but is preferably a porous ply. It is also understood that the top tissue need not have the high stretching capabilities of the embossed tissue and may be of a lower basis weight (e.g., 9–15 vs. 20–28).

THE CONTAINED LAUNDRY ACTIVE

The laundry active product of the present invention comprises an oxidation resistant (OR) tissue and a laundry active contained by said tissue. The term "contained" as used herein means that the laundry active can be inside a pouch comprising the OR tissue or the laundry active can be coated on the OR tissue or impregnated therein. The laundry actives can be selected from detergents, enzymes, softeners, bleaches, etc. The benefits of the present invention are most evident when the laundry active is a dry powdered bleach. The preferred bleach is a dry peroxyacid and this dry powdered bleach is destructive to ordinary tissue and cannot be stored therein for practical periods of time.

A preferred through the wash laundry active product of this invention is a laminate consisting of at least two plies of OR tissue with a multiplicity of nonconnecting cups as shown in the figures. Each cup contains from about 0.5 to 10 cc of laundry active powders. The OR tissue of this invention can withstand the oxidation attack from bleach solids upon storage and can survive automatic washing and drying cycles without splitting asunder while permitting the laundry active powders to dissolve in the wash water.

A preferred method of making the through the wash laminate product shown in FIGS. 1-3 is disclosed in U.S. patent application Ser. No. 675,804, Bedenk and Harden, filed Nov. 24, 1984, incorporated herein by reference.

OXIDATION RESISTANT RESIN

The through the wash laundry active product of this invention is preferably made with an OR tissue made with (or comprising) from 0.01% to 5% of an oxidation resistant resin, preferably 0.1% to 5%, more preferably 0.1% to 3%, and most preferably 0.5% to 1.5%. The preferred resin is made by a process comprising:

STEP 1

Reacting in aqueous solution (a) a linear polymer wherein from 5 to 100% of the recurring units have the formula

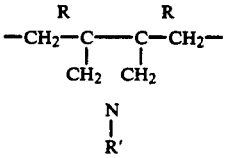

wherein R is hydrogen or lower alkyl and R' is alkyl or a substituted alkyl group wherein the substituent is a group which will not interfere with polymerization through a vinyl double bond and is selected from the group consisting of carboxylate, cyano, ether, amino, amide, hydrazide and hydroxyl groups with (b) from about 0.5 to about 1.5 moles of an epihalohydrin per mole of secondary plus tertiary amine present in said polymer at a temperature of about 30° to about 80° C. and a pH from about 7 to about 9.5 to form a water-soluble resinous reaction product containing epoxide groups; and then

STEP 2 reacting the resinous reaction product, in aqueous solution, with from about 0.3 equivalents to about 1.2 equivalents per equivalent of epihalohydrin of a water-soluble acid selected from the group consisting of hydrogen halide acids, sulfuric acid, nitric acid, phosphoric acid, formic acid and acetic acid until the epoxide groups are converted substantially to the corresponding halohydrin groups and an acid-stabilized resin solution is obtained.

These reaction products of epihalohydrin and polymers of diallylamine and salts thereof and their use in paper are disclosed in U.S. Pat. Nos. 3,700,623, G. I. Keim, issued Oct. 24, 1972, and 3,833,531, G. I. Keim, issued Sept. 3, 1974, both of which are incorporated herein by reference in their entirety.

As reported in U.S. Pat. No. 3,833,531, specific copolymers which can be reacted with an epihaohydrin include copolymers of N-methyldiallylamine and sulfur dioxide; copolymers of N-methyldiallylamine and diallylamine; copolymers of diallylamine and acrylamide; copolymers of diallylamine and acrylic acid; copolymers of N-methyldiallylamine and methyl acrylate; copolymers of diallylamine and acrylonitrile; copolymers of N-methyldiallylamine and vinyl acetate; copolymers of diallylamine and methyl vinyl ether; copolymers of N-methyldiallylamine and vinylsulfonamide; copolymers of N-methyldiallylamine and methyl vinyl ketone; terpolymers of diallylamine, sulfur dioxide and acrylamide; and terpolymers of N-methyldiallylamine, acrylic acid and acrylamide.

The most preferred resin is the HCl stabilized reaction product of epichlorohydrin and poly(N-methyldiallylamine hydrochloride) used at a level of from 0.5% to about 1.5% by weight of the bone dry pulp. Its preferred molecular weight via gel permeation chromatography is about 300,000 to 600,000 and it is made according to the process disclosed herein and similar to that of Example 2 of said U.S. Pat. No. 3,700,623, supra, incorporated herein by reference in its entirety.

The epihalohydrin which is reacted with the polymer of a diallylamine can be any epihalohydrin, i.e., epichlorohydrin, epibromohydrin, epifluorohydrin or epiiodohydrin and is preferably epichlorohydrin. In general, the epihalohydrin is used in an amount ranging from about 0.5 mole to about 1.5 moles and preferably about 1 mole per mole of secondary plus tertiary amine present in the polymer.

The resinous reaction products can be prepared by reacting a homopolymer or copolymer of a diallylamine as set forth above with an epihalohydrin at a temperature of from about 30° C. to about 80° C. and preferably from about 40° C. to about 60° C. until the viscosity measured on a solution containing 20% to 30% solids at 25° C. has reached a range of A to E and preferably about C to D on the Gardner-Holdt scale. The reaction is preferably carried out in aqueous solution to moderate the reaction, and at a pH of from about 7 to about 9.5.

When the desired viscosity is reached, sufficient water is added to adjust the solids content of the resin solution to about 15% or less and the product cooled to room temperature (about 25° C.). The resin solution can be used as such or, if desired, can be adjusted to a pH of at least about 6 and preferably to a pH of about 5. Any suitable acid such as hydrochloric, sulfuric, nitric, formic, phosphoric and acetic acid can be used to adjust the pH.

The aqueous resin solution is applied to synthetic fibers, paper or other felted cellulosic products by tub application or by spraying, if desired. Thus, for example, preformed and partially or completely dried tissue can be impregnated by immersion in, or spraying with, an aqueous solution of the resin, following which the tissue can be heated for about 0.5 minute to 30 minutes at temperatures of 90° C. to 100° C. or higher to dry same and cure the resin to a water-insoluble condition.

The resulting tissue has greatly increased oxidation resistance and wet strength, and therefore this method is well suited for the impregnation of tissue such as through-the-wash pouches for laundry additives, bagged additives, and the like, to impart wet and dry storage strength characteristics thereto.

The preferred method of incorporating these resins in paper, however, is by internal addition prior to sheet formation, whereby advantage is taken of the substantivity of the resins for hydrated cellulosic fibers. In practicing this method, an aqueous solution of the resin in its uncured and hydrophilic state is added to an aqueous suspension of paper stock in the beater, stock chest, Jordan engine, fan pump, head box or at any other suitable point ahead of sheet formation. The sheet is then formed and dried in the usual manner. Curing is achieved by heating at 106° C. for about 5 minutes or at 21° C. for 48 hours.

The "off-the-machine" wet strength obtained with the resins of the invention will be satisfactory for most applications. Additional oxidation resistant wet strength can be obtained by subjecting the paper to a heat treatment. Satisfactory temperatures will be of the order of from about 105° C. to about 150° C. for a period of time from about 12 to 60 minutes, time varying inversely with temperature.

While the OR tissue prepared with the reaction products herein described have substantial oxidation resistant wet strength they also have improved dry storage strength when in direct contact with dry laundry bleach additive. The resin can be present therein in relatively small amounts, i.e., about 0.01% or more, based on the dry weight of the tissue. Generally, it will be desirable to use from about 0.1% to 3% by weight, based on the dry weight of the tissue. However, amounts up to 5% or even 10% by weight, based on the dry weight of the paper, can be used if desired.

The water-soluble acid employed in Step 2 is preferably hydrochloric acid. Preferably from about 0.25 to about 2.5 equivalents, per equivalent of water-soluble acid of a base is reacted with the acid-stabilized resin solution of Step 2. The preferred epihalohydrin is epichlorohydrin. A preferred resin making polymer is a copolymer of N-methyldiallylamine and at least one different monomer selected from diallylamines and monoethylenically unsaturated compounds containing a single vinylidene group. Preferably the polymer of Step 1 is a copolymer of N-methyldiallylamine and sulfur dioxide, a copolymer of N-methyldiallylamine and dimethyldiallylammonium chloride, a copolymer of N-methyldiallylamine and acrylamide, or a copolymer of N-methyldiallylamine and diallylamine. The polymer of Step 2 can be a terpolymer of N-methyldiallylamine, acrylamide and sulfur dioxide, or a homopolymer of N-methyldiallylamine.

In the process for making the resin, the stabilized resin solution of Step 2 is preferably, dried.

The preferred papermaking fibers are northern softwood Kraft fibers. The most preferred resin is the reaction product of epichlorohydrin and poly(N-methyldiallylamine hydrochloride) used at a level of from 0.5% to about 1.5% by weight of the bone dry pulp. Its preferred molecular weight via gel permeation chromatograph is about 300,000 and is made according to the process disclosed herein and in Example 2 of U.S. Pat. No. 3,700,623, supra, incorporated herein by reference in its entirety. Other additives to the papermaking furnish preferably include 2–6 pounds carboxymethylcellulose per ton of bone dry pulp and 0–20 pounds per ton Hercon 48 waterproofing material made by Hercules Incorporated of Wilmington, DE.

THE LAUNDRY ACTIVE POWDERS

The laundry active powders used in the present invention are typical laundry actives: bleaches, softeners, detergents, etc. Examples of powdered detergent materials are disclosed in U.S. Pat. No. 4,404,128, B. J. Anderson, issued Sept. 13, 1983, incorporated herein by reference. Examples of powdered bleach are disclosed in U.S. Pat. No. 4,473,507, F. P. Bossu, issued Sept. 25, 1984, incorporated herein by reference.

EXAMPLE I

The OR Tissue (Papermaking) Example

A pilot-scale papermaking machine was used in the practice of the present invention. The headbox was a fixed roof suction breast roll former and the first foraminous member (Fourdrinier wire) on which the embryonic web was formed was a 33×30 filaments by centimeter five-shed, woven polyester fabric.

The furnish was comprised of 100% northern softwood Kraft pulp fibers with about 13 kilograms of the OR resin per 1000 kilograms of bone dry fibers and about 3 kilograms of Sodium Carboxymethylcellulose CMC-T papermaking additive per 1000 kilograms of bone dry fibers. (Sodium Carboxymethylcellulose CMC-T is manufactured by Hercules, Inc., of Wilmington, DE.) The OR resin of this example is HCl stabilized reaction product epichlorohydrin and poly(N-methyldiallylamine hydrochloride), M.W. 468,000.

The OR resin is activated before use. Activation is accomplished by first adding water to dilute the resin if necessary to about 5% solids content. Then sodium hydroxide as a 50% solution is added to the 5% solids OR resin solution in an amount equal to about 2.5% of the weight of the 5% solution to activate the OR resin. The OR resin solution is properly activated if a 100 ml aliquot of solution reaches a bromothymol blue endpoint when titrated with between 2 and 6 milliliters of one-normal sulfuric acid solution.

The activated OR resin of this example (Ex. *I*) has a solids content of between 4.5% and 5.5%. This is added to furnish at a consistency of between 2.5% and 3.5%. Sodium Carboxymethylcellulose CMC-T in aqueous solution at a solids content of between 0.5% and 1.5% is also added to the furnish after the furnish is diluted to between 0.15% and 0.25% with recycled water from the web forming Fourdrinier section of the papermaking machine.

The web is transferred from the first foraminous member to a deflection member by applying vacuum to the surface of the deflection member opposite to the side of the deflection member to which the web is adhered by vacuum.

The deflection member is an endless belt having the preferred patterned network surface and deflection conduit geometry described in conjunction with FIG. 5. The network surface of the deflection member is formed about a foraminous woven element made of polyester and having 25 (MD) by 25 (CD) filaments per centimeter in a simple (25) weave. Each filament of the woven element is 0.15 mm in diameter; the fabric caliper is about 0.33 mm and its open area is about 39%.

The combined network structure and foraminous woven element has a caliper of about 0.82 mm and the open area of the structure is about 35%.

The blow-through predryer is operated at a temperature of about 220° C. The Yankee drum is operated at a saturated steam pressure of about 8.8 kilograms per square centimeter.

The first foraminous member is operated at a speed of about 183 meters per minute and the deflection member at a speed of about 151 meters per minute. The paper is wound on a reel at a speed of about 145 meters per minute.

The consistency of the embryonic web at the point of transfer from the Fourdrinier first foraminous member to the deflection member is about 15%. At the point of entering the blow-through predryer the consistency of the web on the deflection member is about 25% and at the point of discharge from the predryer and application to the Yankee dryer the web consistency is between 60% and 70%.

The web is transferred from the deflection member and adhered to the Yankee dryer through a combination of pressure applied by a nip-forming pressure roll to the deflection member from the side opposite to the web side and polyvinyl alcohol adhesive applied to the Yankee surface and the predried paper web.

The web is creped from the surface of the Yankee dryer with a doctor blade having an 84° angle of impact. The consistency of the web at the point of removal from the Yankee surface is about 97%.

The gross orientation of the fibers was adjusted by controlling the flow of dilute 0.15% to 0.25% consistency furnish to the headbox through adjustment of the flow rate of the pump supplying furnish to the headbox. The gross orientation was adjusted so that the ratio of dry tensile strength measured in the machine direction was between 1.5 and 2.1 times the dry tensile strength measured in the cross-machine direction.

Variations in the basis weight, wet strength, resin type and level, caliper and CMC level were made and are reported in Table 2.

The physical properties of the different tissues were measured and are tabulated in Table 3 below.

EXAMPLE II

A typical element of a laundry additive product made with the OR tissue of Example I is given below. The materials of the detergent mix and the bleach mix are each separately blended and added to separate rows of the embossed OR tissue (5), as shown in FIGS. 1–3. The OR tissue in this example was embossed or stretched as shown in FIG. 2, about 30% to 40% with the greatest stretch at cup sides (5*b*). A sheet of laminated through the wash laundry product like the one shown in FIG. 1 was made using a process like the one outlined in U.S. patent application Ser. No. 675,804, supra, incorporated herein by reference. The 48 cells, each approximately 1×1×0.13 inches, contain a volume of about 2.1 cc each. The OR tissue used is that of Example 1. An inch is equal to 2.54 cm.

The product contained 24 cells of the detergent and 24 cells of the bleach mix. Each of the detergent cells contained about 0.9 g of detergent which is about 1.6 cc of powder. Each of the bleach cells contained about 1.4 g bleach or about 2.0 cc of bleach powder. It should be noted that the total amount of peroxyacid bleach in one sheet of this product provides about 16 ppm AvO in a 64 liter wash. The total amounts of laundry actives laminated in each sheet are set out in Table 1.

TABLE 1

| Ingredient | Grams Per Sheet |
|---|---|
| Sodium tripolyphosphate | 5.70 |
| Sodium acid pyrophosphate | 5.00 |
| Linear alkyl benzene sulfonate | 8.50 |
| Silicone silicate | 0.15 |
| Tallow alkyl ethoxylate | 0.30 |
| Protease-amylase enzymes | 0.90 |
| Optical brighteners | 0.70 |
| Perfume | 0.15 |
| Total detergent mix | 21.40 |
| Bleach mix (3.0% AvO from diperoxydodecanedioic acid) | 33.00 |
| Total weight on sheet | 54.40 |
| OR Tissue of Example 1 | 7.90 |
| Hot melt adhesive | 1.50 |
| Total weight per sheet | 63.80 |

When these laminated through the wash laundry products were placed in a washing machine, the cleaning performance was identical to that obtained when the equivalent amounts of laundry actives were used. The selection of OR tissue and cell size insured the flow of water into the laminates and the flow of dissolved and suspended powders through the OR tissue. The powders were introduced into the wash liquor rapidly. By dividing the total amount of powder into 48 separate compartments, all the powder came into contact with water very rapidly which was important to keeping total dissolution time to a minimum.

At the end of the wash cycle, the laminates were examined and found to be intact except for the powders which had dissolved. The OR tissue of the laminate was wrinkled but untorn. The spent laminated OR tissue sheet was not removed from the load of wet fabrics at this stage, but was carried along with the fabrics to the dryer. The spent OR tissue sheet was dried with the rest of the fabrics. No problem was encountered in the dryer. The spent dried sheet was easily separated from the rest of the fabrics after the drying operation. Examination of the spent OR tissue sheet showed the tissue was still intact after the drying cycle. The pH of the wash can be 7 to 10.

The OR test defined herein provides a practical test of the ability of tissue to withstand the rigors of an automatic bleaching wash. The laminated tissues of Example II are run through two washing cycles of a Miele European washer. This test consists of two 1-hour cycles with water temperatures ranging from room temperature to 205° F. (96° C.) with a full load of fabrics. Even with this rigorous treatment the laminated OR tissue sheets remain intact.

Figure 4:
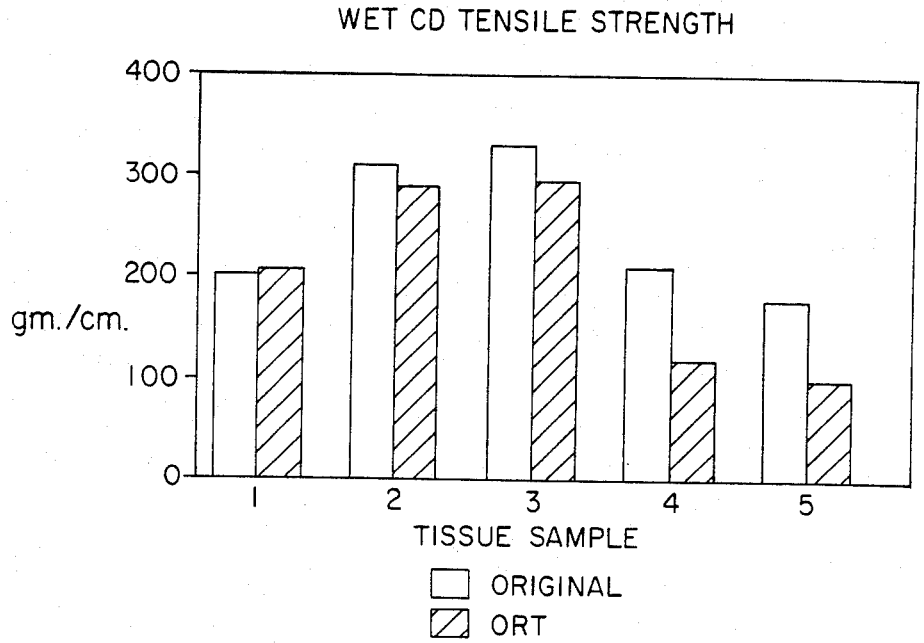
FIG. 4 is a potent graphical illustration of the benefit of oxidation resistivity of OR tissues used in the claimed invention.

The parameters set out in Tables 2 are used in the making of the various tissues for the Oxidation Resistance Test with results illustrated in FIG. 4. Northern softwood Kraft pulp is used in all examples. Knowledge of these conditions and the above description of the papermaking process constitute an adequate description for one skilled in the art of papermaking to make these papers. The properties of the tissues are set out in Table 3.

TABLE 2

| Tissue Examples | Basis Weight (lbs/3Mft$^2$) | Resin Type | Resin Level (lbs/ton) | CMC Level (lbs/ton) | Dry Caliper (mm) |
|---|---|---|---|---|---|
| 1 | 28 | Ex. 1 | 25 | 6 | 0.73 |

TABLE 2-continued

| Tissue Examples | Basis Weight (lbs/3Mft$^2$) | Resin Type | Resin Level (lbs/ton) | CMC Level (lbs/ton) | Dry Caliper (mm) |
|---|---|---|---|---|---|
| 2 | 22 | Ex. 1 | 30 | 6 | 0.72 |
| 3 | 22 | Ex. 1 | 20 | 4 | 0.72 |
| 4 | 22 | 557H* | 25 | 6 | 0.71 |
| 5 | 28 | 557H | 25 | 6 | 0.58 |

The OR resin Ex. 1 is described in Example 1.
*Kymene 557H, available from Hercules, is outside the scope of this invention.

TABLE 3

| Tissue Examples | Tensile Strength Measurements: Dry Tensile (g/cm) MD | Dry Tensile (g/cm) CD | Dry Stretch (%) MD | Dry Stretch (%) CD | Cured Wet CD Tensile (g/cm) |
|---|---|---|---|---|---|
| 1 | 615 | 348 | 50 | 24 | 110 |
| 2 | 430 | 394 | 41 | 19 | 172 |
| 3 | 479 | 383 | 43 | 20 | 151 |
| 4 | 670 | 374 | 49 | 22 | 124 |
| 5 | 635 | 387 | 47 | 23 | 112 |

*Cured refers to placing a sample of tissue immediately from the papermaking machine into a convection oven at 221° F. for 5.0 minutes of curing. This approximates the strength achieved with long term room temperature curing.

Stretch is the percent elongation of the tissue, as measured at rupture, and is read directly from a second digital readout on the Instron tensile tester. Stretch readings are taken concurrently with tensile strength readings.

The OR tissue used in the present invention must have certain physical characteristics.

First: An original wet tensile strength of at least 78 g/CM, and

Second: An Oxidation Resistance Test tensile strength of at least 77% of the original.

OXIDATION RESISTANCE TEST PROCEDURE

This test is composed of two parts.

Principle

Determine the loss in wet strength that occurs to a sample of tissue that is subjected to oxidative conditions.

Apparatus

1. Instron Model 1122 Tensile Tester with 2 inch jaws and a stationary 0.25 diameter×2.0 inch (0.64 diameter×5.08 cm) bar
2. Thwing Albert Model JDC 25 precision sample cutter
3. 4 liter beaker
4. Laboratory hot plate
5. Linear alkyl ($C_{12}$) benzene sulfonate
6. Hydrogen peroxide 35% in water
7. NaOH solution 1% in water
8. Deionized water
9. Antifoamant (silicone oil)

Sample

A 1 inch×9 inch (2.54 cm×22.86 cm) CD sample of tissue is cut such that the long axis of the sample is oriented perpendicular (90 degrees) to the machine direction of the tissue. Run 3 replications of each tissue sample strip and take averages.

Part 1

Oxidation Resistant Treatment

The samples are subjected to a 5 minute boil treatment and measurement. The solution for the boil treatment is 200 ppm in LAS and 200 ppm AvO of hydrogen peroxide. The pH of the solution is adjusted to pH 10 with NaOH after the LAS and the hydrogen peroxide are added. The samples of tissue used are 9×1 inch CD strips and are subsequently tested on an Instron tensile testing apparatus. Adequate performance must occur before a tissue can qualify as oxidation resistant. The test simulates the conditions seen by tissues under European boil wash conditions and/or under strenuous U.S. conditions wherein the wash temperature is up to 90° to 100° C. with standard levels of surfactant and hydrogen peroxide bleach. The level of surfactant is 200 ppm and the level of bleach is about 200 ppm available oxygen (AvO).

Procedure

1. Heat 3 liters of water to boiling and place 0.6 g LAS (Calsoft 90, Pilot Chemical) and 4.3 g $H_2O_2$ (35%) along with 0.03 g of silicone oil in the solution.
2. Immediately adjust the pH of the solution to pH 10 with the 1% NaOH solution.
3. Start the timer and put 15 or fewer sample strips into the solution for 5 minutes.
4. After 5 minutes remove the tissue strips and rinse with cold deionized water.
5. Place one sample strip in the Instron such that there is a 4 inch gauge length and the sample is looped over the horizontal bar and attached to the jaws.
6. Pull the sample at a speed of 1.29 cm/sec (0.5 inch/sec.) until the maximum load is reached.
7. Record the maximum load and reset the Instron for another sample.
8. Repeat from Step 5.
9. A retention of at least 77% of the original wet tensile strength indicates a satisfactory oxidation resistant tissue.

Part 2

Original Cross-Direction (CD) Wet Tensile Strength

The original wet (CD) tensile strength is measured as above from Step 5, except that the tissue is saturated with only deionized water.

The results are as shown below in Table 4 and graphically illustrated in FIG. 4.

TABLE 4

| Tissue Examples | Resin | 5 Min. Boil % Original ORT Tensile |
|---|---|---|
| 1 | Ex. 1 | 101.5 |
| 2 | Ex. 1 | 92.6 |
| 3 | Ex. 1 | 89.7 |
| 4 | 557H | 56.3 |
| 5 | 557H | 55.2 |

The OR resin employed in the tissues of Examples 1, 2 and 3, is the reaction product of epichlorohydrin and poly(N-methyldiallylamine hydrochloride) having a gel permeation chromatograph molecular weight of about 468,000 and is similar to the one disclosed in Example 1. The levels of this resin used in Examples 1, 2 and 3 are, respectively, 1.25%, 1.5% and 1.0% by weight of the tissue. The resin is made according to the process generally described in Example 2 of U.S. Pat. No. 3,700,623, G. I. Keim, issued Oct. 24, 1972, incorporated herein by reference in its entirety.

The tissues employing the OR resin of Example 1 perform much better than the tissues using Kymene 557H. A retention of 77% or more of the original wet tensile strength in the OR test constitutes the condition necessary for oxidation resistance.

See FIG. 4 for a graphical illustration of the superior retention of wet strength of the OR tissues 1, 2 and 3 used in this invention after subjection to oxidative conditions. The bar numbers correspond to the tissue Examples of Tables 2, 3 and 4.

Thus, it will be appreciated that this invention is an improved, premeasured, through the wash dry laundry active product comprised of an oxidation resistant tissue and dry laundry actives contained therein. The oxidation resistant (OR) tissue is particularly useful as a durable substrate and a convenient vehicle for delivering laundry additives to a wash liquor comprising bleach. The improved products of this invention are storage stable, deliver premeasured actives and survive the wash without tearing or rending asunder.

What is claimed is:

1. A through the wash laundry product comprising a laundry active contained by an OR tissue, wherein said OR tissue contains from about 0.1% to about 10% of of an oxidation resistant resin selected from a resin made by a process comprising the following steps:

(1) reacting in aqueous solution (a) a linear polymer wherein from 5 to 100% of the recurring units have the formula

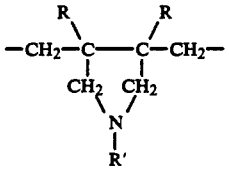

wherein R is hydrogen or lower alkyl and R' is alkyl or a substituted alkyl group wherein the substituent is a group which will not interfere with polymerization through a vinyl double bond and is selected from the group consisting of carboxylate, cyano, ether, amino, amide, hydrazide and hydroxyl groups with (b) from about 0.5 to about 1.5 moles of an epihalohydrin per mole of secondary plus tertiary amine present in said polymer at a temperature of about 30° to about 80° C. and a pH from about 7 to about 9.5 to form a water-soluble resinous reaction product containing epoxide groups; and then (2) reacting the resinous reaction product, in aqueous solution, with from about 0.3 equivalents to about 1.2 equivalents per equivalent of epihalohydrin of a water-soluble acid selected from the group consisting of hydrogen halide acids, sulfuric acid, nitric acid, phosphoric acid, formic acid and acetic acid until the epoxide groups are converted substantially to the corresponding halohydrin groups and an acid-stabilized resin solution is obtained;

wherein said an OR tissue has an original wet CD tensile strength of at least about 200 g/inch (78 g/cm) and Oxidation Resistance Test tensile strength of at least 77% of said original wet CD tensile strength.

2. The through the wash laundry product of clam 1 wherein said OR tissue has an original wet CD tensile strength of at least 100 grams per centimeter and a basis weight of 15–35 lbs per ream (24 to 57 g/m$^2$) and wherein said tissue has an OR resin present in said tissue at a level of 0.1% to 5%.

3. The through the wash laundry product of claim 1 wherein said tissue has an Oxidation Resistance Test tensile strength is at least 80% of its original wet CD tensile strength.

4. The through the wash laundry active product of claim 1 wherein said OR resin level is from 0.1% to 3%.

5. The through the wash laundry product of claim 1 wherein the water-soluble acid employed in Step 2 is hydrochloric acid.

6. The through the wash laundry product of claim 1 wherein from about 0.25 to about 2.5 equivalents, per equivalent of water-soluble acid of a base is reacted with the acid-stabilized resin solution of Step 2.

7. The through the wash laundry product of claim 6 wherein the epihalohydrin is epichlorohydrin.

8. The through the wash laundry product of claim 7 wherein the polymer is a copolymer of N-methyldiallylamine and a least one different monomer selected from diallylamines and monoethylenically unsaturated compounds containing a single vinylidene group.

9. The through the wash laundry product of claim 7 wherein the polymer is a copolymer of N-methyldiallylamine and sulfur dioxide.

10. The through the wash laundry product of claim 7 wherein the polymer is a copolymer of N-methyldiallylamine and dimethyldiallylammonium chloride.

11. The through the wash laundry product of claim 7 wherein the polymer is a terpolymer of N-methyldiallylamine, acrylamide and sulfur dioxide.

12. The through the wash laundry product of claim 8 wherein the polymer is a copolymer of N-methyldiallydamine and acrylamide.

13. The through the wash laundry product of claim 8 wherein the polymer is a copolymer of N-methyldiallylamine and diallylamine.

14. The through the wash laundry product of claim 1 wherein the stabilized resin solution of Step 2 is dried.

15. The through the wash laundry product of claim 7 wherein the polymer is the homopolymer of N-methyldiallylamine.

16. The through the wash laundry product of claim 1 wherein said OR tissue contains about 0.5% to 1.5% N-methyldiallylamine hydrochloride resin, and has a gel permeation chromatograph molecular weight of 300,000 to 600,000.

17. The through the wash laundry product of claim 1 wherein said OR tissue has a porosity of from about 80 to 180 CFM/ft$^2$.

18. The through the wash laundry product of claim 1 wherein said OR tissue has a basis weight of from about 20 to about 25 lbs. per 3,000 sq. ft. (32–41 g/m$^2$).

19. The through the wash laundry product of claim 1 wherein said OR tissue has a dry caliper of from about 20 to about 30 mils (0.51–0.76 mm).

20. The through the wash laundry product of claim 1 wherein said OR tissue has air permeability of from about 80–180 CFM/ft$^2$ and wherein said product is selected from pouches and laminates of a multiplicity of cups containing said actives.

21. The through the wash laundry product of claim 1 wherein said active is a peroxyacid bleach.

22. The through the wash laundry product of claim 1 wherein said product is:

a laminate consisting of at least two plies of which at least one ply is said OR tissue;

said one ply having a multiplicity of nonconnecting cups surrounded by rims, each cup having sides and a base;

from about 0.5 to 10 cc of laundry active powders contained in each cup, said active being selected from powdered detergents, builders, enzymes, said bleach solids, fillers, other laundry additives;

the other of said two plies covering the cup ply forming patterned cells which contain the powder, said plies being sealed on said rims;

said OR tissue is selected to withstand the oxidation attack from bleach solids and to survive bleach wash liquors in automatic washing and drying cycles without splitting asunder while permitting the powders to dissolve in the wash water.

23. The through the wash laundry product of claim 1 wherein said wash contains bleach at a level of from 5 to 440 ppm available oxygen at a pH of at least 8 and a surfactant present at a level of 150 ppm to 2000 ppm.

24. The through the wash laundry product of claim 23 wherein the bleach is a peroxyacid bleach present at a level which would provide an average wash with an available oxygen of 5 ppm to 100 ppm at a pH of about 9.5.

25. The through the wash laundry product of claim 1 wherein said tissue contains synthetic papermaking fibers.

* * * * *

UNITED STATES PATENT AND TRADEMARK OFFICE

CERTIFICATE OF CORRECTION

PATENT NO. : 4,652,390

DATED : March 24, 1987

INVENTOR(S) : Norman A. Strampach, Vincent L. Cerchio, Jr., and William W. Schmidt It is certified that error appears in the above-identified patent and that said Letters Patent is hereby corrected as shown below:

Col. 1, line 29, "the" should be -- their --.

Col. 6, line 27, "secification" should be -- specification --.

Col. 7, lines 40-45, the formula

"

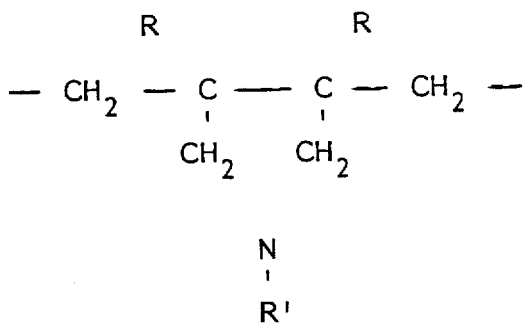

"

should read --

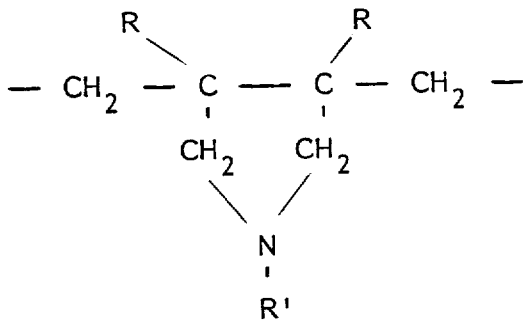

UNITED STATES PATENT AND TRADEMARK OFFICE

CERTIFICATE OF CORRECTION

PATENT NO. : 4,652,390

DATED : March 24, 1987 Page 2 of 2

INVENTOR(S) : Norman A. Strampach, Vincent L. Cerchio, Jr., and William W. Schmidt It is certified that error appears in the above-identified patent and that said Letters Patent is hereby corrected as shown below:

Col. 9, line 66, after "300,000" insert -- to 600,000 --.

Col. 13, line 12, at the end of Table 2 insert ---

Where: Resin = wet strength resin;
CMC = sodium carboxylmethylcellulose;
Caliper = thickness;
Resin and CMC Levels are reported as lbs/ton of bone dry pulp.

Signed and Sealed this

Twenty-ninth Day of March, 1988

*Attest:*

DONALD J. QUIGG

*Attesting Officer*

*Commissioner of Patents and Trademarks*